US009546033B2

(12) United States Patent
Everingham

(10) Patent No.: US 9,546,033 B2
(45) Date of Patent: Jan. 17, 2017

(54) SQUARE BOWL WITH CRACKER COMPARTMENT

(71) Applicant: Barry Everingham, Waterford, MI (US)

(72) Inventor: Barry Everingham, Waterford, MI (US)

(73) Assignee: Design Nuts Innovations, LLC, Waterford, MI (US)

( * ) Notice: Subject to any disclaimer, the term of this patent is extended or adjusted under 35 U.S.C. 154(b) by 0 days.

(21) Appl. No.: 14/272,617

(22) Filed: May 8, 2014

(65) Prior Publication Data

US 2014/0335237 A1 Nov. 13, 2014

Related U.S. Application Data

(60) Provisional application No. 61/820,940, filed on May 8, 2013.

(51) Int. Cl.

| | |
|---|---|
| ***B65D 85/00*** | (2006.01) |
| ***B65D 81/32*** | (2006.01) |
| *B65D 81/34* | (2006.01) |
| *B65D 51/24* | (2006.01) |
| *B65D 51/28* | (2006.01) |

(Continued)

(52) U.S. Cl.

CPC ..... *B65D 81/32* (2013.01); *B65D 51/28* (2013.01); *B65D 81/3294* (2013.01); *B65D 51/246* (2013.01); *B65D 51/247* (2013.01); *B65D 51/2807* (2013.01); *B65D 51/2857* (2013.01); *B65D 65/02* (2013.01); *B65D 65/14* (2013.01); *B65D 81/34* (2013.01); *B65D 81/343* (2013.01)

(58) Field of Classification Search

CPC ..... B65D 81/32; B65D 81/343; B65D 85/70; B65D 85/804; B65D 85/808; B65D 85/8085; B65D 51/246

USPC ..... 426/112–114, 119, 396, 394, 106, 115, 426/120; 220/495.03, 707; 206/486, 462, 206/460

See application file for complete search history.

(56) References Cited

U.S. PATENT DOCUMENTS 2,336,699 A 12/1943 Neth et al.
3,385,501 A * 5/1968 Chang ..... B65D 77/2056 215/229

(Continued)

FOREIGN PATENT DOCUMENTS

| | | |
|---|---|---|
| AT | 009947 U1 | 6/2008 |
| DE | 801409 C | 1/1951 |
| JP | 2006062730 A | 3/2006 |

OTHER PUBLICATIONS

International Search Report/Written Opinion PCT/US2015/029572, dated Sep. 11, 2015, 7 pages.

*Primary Examiner* — Drew Becker
*Assistant Examiner* — Bryan Kim
(74) *Attorney, Agent, or Firm* — Varnum, Riddering, Schmidt & Howlett LLP

(57) ABSTRACT

A bowl for storing and serving food products is provided. The bowl includes a bottom panel connected to at least one side panel. The at least one side panel and the bottom panel form a bowl compartment operable to hold soup or other food items. The bowl further includes a pair of opposed handles positioned at the top of the at least one side panel adapted to facilitate pouring of the contents of the bowl. The bottom panel includes a bottom surface. The bottom surface includes an indentation adapted to store food and tools to accompany the soup. A flexible film is removably attached (Continued)

to the bottom surface of the bottom panel, the flexible film covering the indentation allowing food to be stored in the indentation.

17 Claims, 3 Drawing Sheets

(51) Int. Cl.
*B65D 65/14* (2006.01)
*B65D 65/02* (2006.01)

(56) References Cited

U.S. PATENT DOCUMENTS 3,415,663 A 12/1968 Raschke et al.
3,424,342 A 1/1969 Scoop et al.
3,506,107 A 4/1970 Tarzain
3,997,677 A 12/1976 Hirsch et al.
4,058,247 A 11/1977 Florian
4,373,642 A 2/1983 Wolters et al.
D277,632 S 2/1985 Staufenberg
4,555,056 A 11/1985 Bernhardt
4,577,080 A * 3/1986 Grossman ..... 219/689
4,787,527 A 11/1988 Monetti
4,819,824 A 4/1989 Longbottom et al.
D305,086 S 12/1989 Stewart
4,978,022 A * 12/1990 Weick ..... B65D 43/0212 206/219
5,012,928 A 5/1991 Proffitt et al.
D318,982 S 8/1991 Gecchelin
5,293,997 A 3/1994 Hustad et al.
D350,880 S 9/1994 VanValkenburg et al.
5,344,021 A 9/1994 Rose
D351,090 S 10/1994 Narsutis
D351,765 S 10/1994 Beeler et al.
D352,423 S 11/1994 Laib
D355,814 S 2/1995 VanValkenburg et al.
D357,161 S 4/1995 Booten
5,593,610 A 1/1997 Minerich et al.
D378,563 S 3/1997 Ferris
D388,325 S 12/1997 Tucker et al.
D390,109 S 2/1998 Tucker et al.
D411,741 S 6/1999 Wilson et al.
D424,879 S 5/2000 Biber
D428,310 S 7/2000 Zettle et al.
D428,777 S 8/2000 Hayes et al.
D429,965 S 8/2000 Hayes et al.
6,170,696 B1 1/2001 Tucker et al.
D440,470 S 4/2001 Tucker et al.
D440,830 S 4/2001 Tucker et al.
D441,597 S 5/2001 Wyche
D443,184 S 6/2001 Maxwell et al.
D443,798 S 6/2001 Tucker et al.
D445,649 S 7/2001 Maxwell et al.
D446,077 S 8/2001 Tucker et al.
D449,495 S 10/2001 Tucker et al.
6,305,546 B1 10/2001 Saunders et al.
D450,983 S 11/2001 Tucker et al.
6,372,270 B1 * 4/2002 Denny ..... 426/77
D462,880 S 9/2002 Maxwell et al.
D466,299 S 12/2002 Zimmerman
6,672,473 B2 * 1/2004 Torniainen et al. ..... 220/657
D488,352 S 4/2004 Tisdale et al.
6,761,041 B2 7/2004 Roth et al.
D501,365 S 2/2005 Kellermann et al.
D505,835 S 6/2005 Schultz et al.
D505,839 S 6/2005 Stanos et al.
D505,840 S 6/2005 Schultz et al.
D512,278 S 12/2005 Schultz et al.
6,989,168 B2 * 1/2006 Fahey ..... 426/120
D515,438 S 2/2006 Baranowski et al.
D524,096 S 7/2006 Babkes
D527,956 S 9/2006 Doliwa
D540,122 S 4/2007 Wasserman et al.
D542,098 S 5/2007 Wasserman et al.
7,264,120 B2 9/2007 Turvey et al.
7,357,272 B2 4/2008 Maxwell
D570,681 S 6/2008 Hussain et al.
7,387,082 B1 6/2008 Fried
D572,979 S 7/2008 Delbaere
D575,095 S 8/2008 Schreiber-Pethan et al.
D588,417 S 3/2009 Doliwa
D589,759 S 4/2009 Ozery et al.
7,552,835 B2 6/2009 Kiel et al.
D600,111 S 9/2009 Gerulski et al.
D628,479 S 12/2010 Snedden et al.
D630,091 S 1/2011 Schick
D632,170 S 2/2011 Lawrence et al.
D635,848 S 4/2011 Lawrence et al.
D636,258 S 4/2011 Freeman et al.
D637,482 S 5/2011 Snedden et al.
D640,506 S 6/2011 Garg et al.
D640,550 S 6/2011 Snedden et al.
D640,899 S 7/2011 Shing
D642,904 S 8/2011 Turvey
D653,913 S 2/2012 Stamper et al.
D654,321 S 2/2012 Garg et al.
8,365,920 B2 2/2013 House et al.
2006/0158886 A1 * 7/2006 Lee ..... 362/318
2006/0180483 A1 * 8/2006 Sekendur ..... B65D 51/246 206/216
2007/0071852 A1 * 3/2007 Krueger ..... A23K 1/1846 426/106
2008/0302678 A1 * 12/2008 Hunwisk ..... B65D 25/04 206/222
2009/0004336 A1 * 1/2009 La et al. ..... 426/85
2009/0039076 A1 * 2/2009 Maslowski ..... A47J 36/027 219/729
2012/0037652 A1 2/2012 Turvey et al.
2013/0074455 A1 * 3/2013 Gillblad ..... B65B 29/08 53/469

* cited by examiner

SQUARE BOWL WITH CRACKER COMPARTMENT

PRIORITY

This application claims priority of U.S. Patent Application No. 61/820,940 filed May 8, 2013, the contents of which are incorporated herein by reference.

FIELD OF THE INVENTION

This invention relates generally to bowls for food consumption. More particularly, this invention relates to a bowl having auxiliary storage.

SUMMARY OF THE INVENTION

A bowl for storing and serving food products is provided. The bowl includes a bottom panel connected to at least one side panel. The at least one side panel and the bottom panel form a bowl compartment operable to hold soup or other food items. The bowl further includes a pair of opposed handles positioned at the top of the at least one side panel adapted to facilitate pouring of the contents of the bowl. The bottom panel includes a bottom surface. The bottom surface includes an indentation adapted to store food, serving tools or condiments such as crackers, napkins, sauces, etc. to accompany the soup. A flexible film is removably attached to the bottom surface of the bottom panel, the flexible film covering the indentation allowing food to be stored in the indentation.

In a preferred embodiment, the indentation is at least 0.5 (and up to 2 inches deep) inches deep. In another embodiment, the indentation is at least 0.75 inches deep. The indentation is at least 1.5 to 1.85 inches wide and may be square, rectangular, circular . . . etc. to accommodate the food stored within.

A flexible film is provided to seal the contents of the indentation so as to prevent air or water from entering the indentation and causing damage to the food or constants. The flexible film includes an adhesive applied to a first surface of the flexible film to connect to both the bottom surface of the bowl and to connect to a package of food stored within the indentation thereby pulling the package of food out of the indentation when the flexible film is removed.

BACKGROUND OF THE INVENTION

Heatable and microwavable containers, such as bowls, are well known and frequently used to store various food items. These bowls are typically circular in shape allowing for a user to accidently tip the bowl over. It is well known in the art during use of a bowl to eat the food product with a cracker or other snack or condiments. Further, it is common to pour the soup or other food contained within the bowl into a separate bowl. However, these bowls lack a spout or handles to assist in pouring. Accordingly, there exists a need in the art to provide a bowl having a storage compartment for a cracker or other snack while also providing appropriate handles and spout means.

DETAILED DESCRIPTION OF THE INVENTION

The present invention provides for a square bowl having a storage cracker compartment disposed on the bottom surface of the bowl. The bowl is square in shape having a wide base to prevent tipping. The bowl further includes opposed handles and two opposed spouts to facilitate easy pouring. These corners, or spouts, include a radius of 66 to negate dripping. The present embodiment includes the 66 degrees (Radius), however, other embodiments may range from 40-70.

Figure 1:
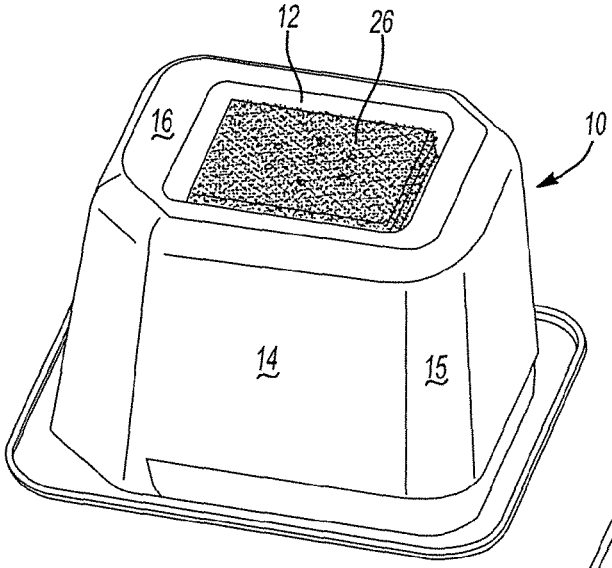
FIG. 1 illustrates a perspective view of the bowl in an upside-down view with a cracker in the storage compartment.

FIG. 1 illustrates a photograph of two views of the bowl 10. The image on the left illustrates the bowl 10 having a cracker storage compartment 12. The present embodiment described herein discloses the cracker/condiments/tools storage compartment 12 for use of storage of crackers or other tools or foods. However, the compartment 12 may be used to store various other food items or utilitarian items such as a fork, spoon, knife, condiments or napkin. The bowl 10 includes an outer side surface 14 forming the general square shape of the bowl. The surface 14 further includes angled side surface edges 15. The bowl 10 further includes a bottom surface 16 and an inner surface 18.

In the present embodiment, the bowl 10 is used to store a soup or stew sauces, noodles, rice and other foods. The bowl 10 is microwavable or heatable by various other means. The bowl 10 may be placed in a hot water bath to heat the contents of the bowl to the appropriate temperature.

The indentation 12 creates a protrusion into the interior surface 18 of the bowl 10. The protrusion includes an upper surface 20 and side surfaces 22. The side surfaces 22 raise up from the lower inner surface 24 of the bowl 10.

In the present embodiment, the compartment 12 of the bowl 10 includes the crackers 26. The crackers are stored in a wrapper such as a clear film material. In the present embodiment, crackers are placed in twos into a package and then placed into the compartment 12.

The bowl 10 further includes an upper surface 28 having an outer edge 30. The outer edge 30 is a peripheral edge extending around the upper top side of the bowl 10. The upper surface 28 includes opposed handles 32*a*, 32*b*. The handles 32*a*, 32*b* are rounded at an outermost point 33 and have a straight angled portion 31 thereby creating a generally triangular shape of the handles 32*a*, 32*b*. The opposed handles 32*a*, 32*b* allow the user to tilt the bowl and pour its contents into a separate container.

The bowl 10 further includes opposed spouts 34*a*, 34*b*. The spouts 34*a*, 34*b* have a general radius between 0.4-0.8 radians. The radius should be small enough to thoroughly direct the liquid or other contents contained within the bowl 10 smoothly by means of the spout 34*a*, 34*b*. The opposed handles 32*a*, 32*b* allow the user to pour the contents by means of the spouts 34*a*, 34*b*.

The compartment 12 further includes a surface 36 for which the crackers 26 rest upon. The surface 36 is opposed from the inner surface 20 contained within the bowl 10. The crackers, or the cellophane or film wrapping the crackers, rests upon or adjacent to the surface 36.

Figure 2:
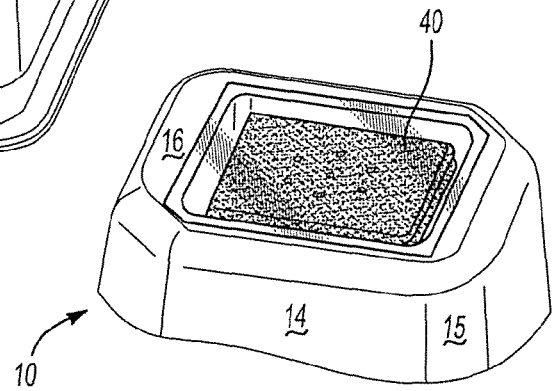
FIG. 2 illustrates a perspective view of the bowl in an upside-down view with a cracker in the storage compartment with the film covering the cracker compartment.
Figure 3:
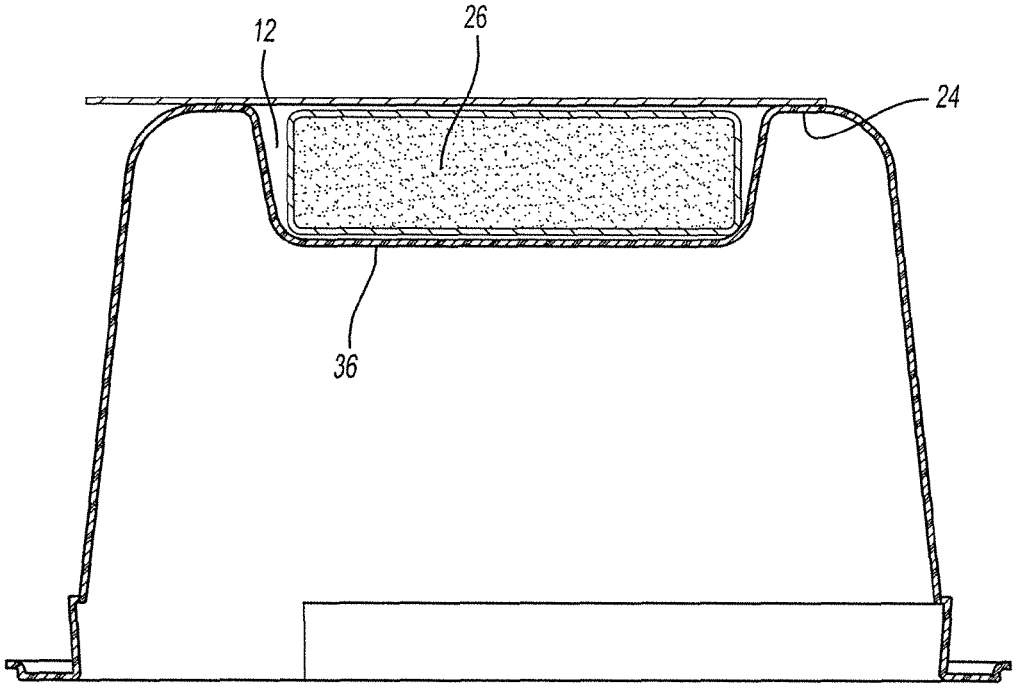
FIG. 3 illustrates a cross-sectional view of the bowl.

FIGS. 2 and 3 illustrate the film 40 covering the compartment 12 of the bowl 10. The film 40 may be a clear film, printed film cellophane, plastic, foil, or other flexible film-type material. The film 40 should be large enough to cover the compartment 12 to hold the crackers 26 within the compartment 12. Alternatively, the film 40 may only cover a portion of the compartment 12 but still hold in the crackers 26.

The film 40 includes an adhesive 42. The adhesive 42 may be a glue or other known adhesive in the art. The adhesive 42 rests adjacent to and contacts a cracker wrapper 44. The cracker wrapper 44 (which may optionally be used) is a cellophane or film-like material covering the crackers 26 to keep them fresh. The film 40 may also include an optional tab 46 allowing the user to easily remove the film 40.

The film 40 includes an outer surface 48 and an inner surface 50. The outer surface 48 is generally smooth not having any adhesive material (the label may have glue on it). The outer surface 48 may include printing, instructions, nutrition information, or other images. The film 40 may extend partially over the bowl to form the optional tab 46. The inner surface 50 includes an adhesive 42. The adhesive 42 contacts with the cracker wrapper 44 of the cracker 26. The adhesive 42 contacts the cracker wrapper 44 allowing the user to remove the crackers 26 from the compartment 12 upon removal of the film 40 from the lower surface 16 of the bowl 10. The adhesive 42 of the film 40 further contacts the lower surface 16 of the bowl 10.

Figure 4:
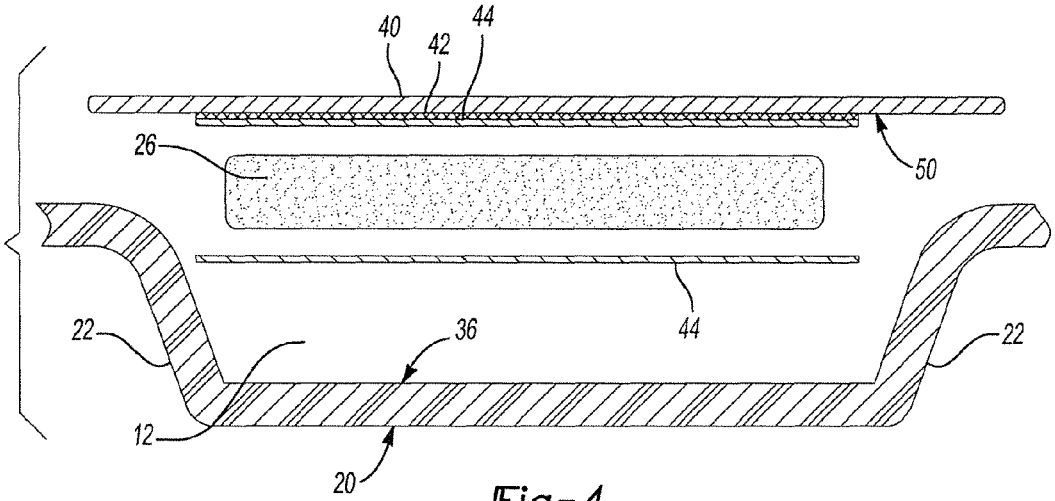
FIG. 4 illustrates a cross-sectional view of the bowl illustrating the cracker wrapper and film adhered to the cracker wrapper.
Figure 5:
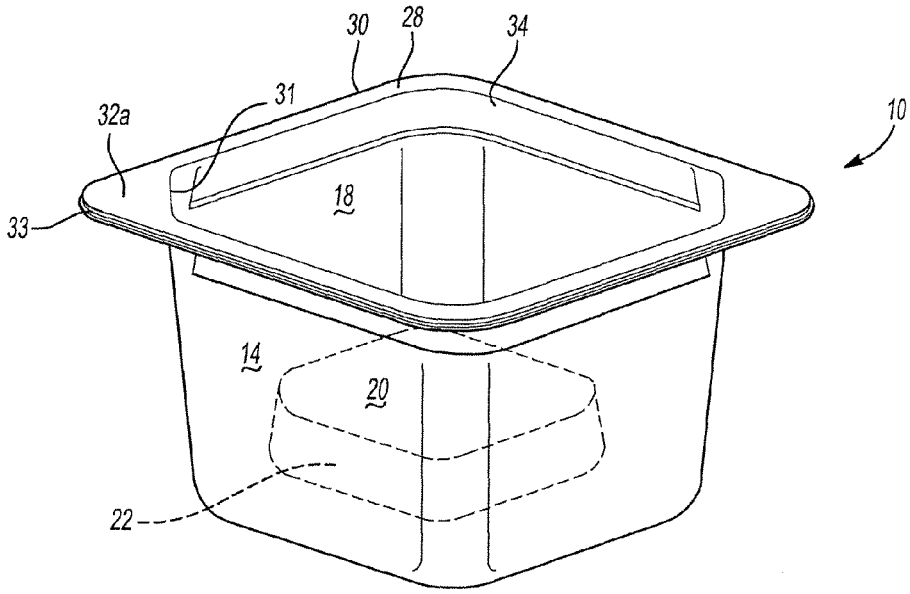
FIG. 5 illustrates a perspective view of the bowl having the depression.
Figure 6:
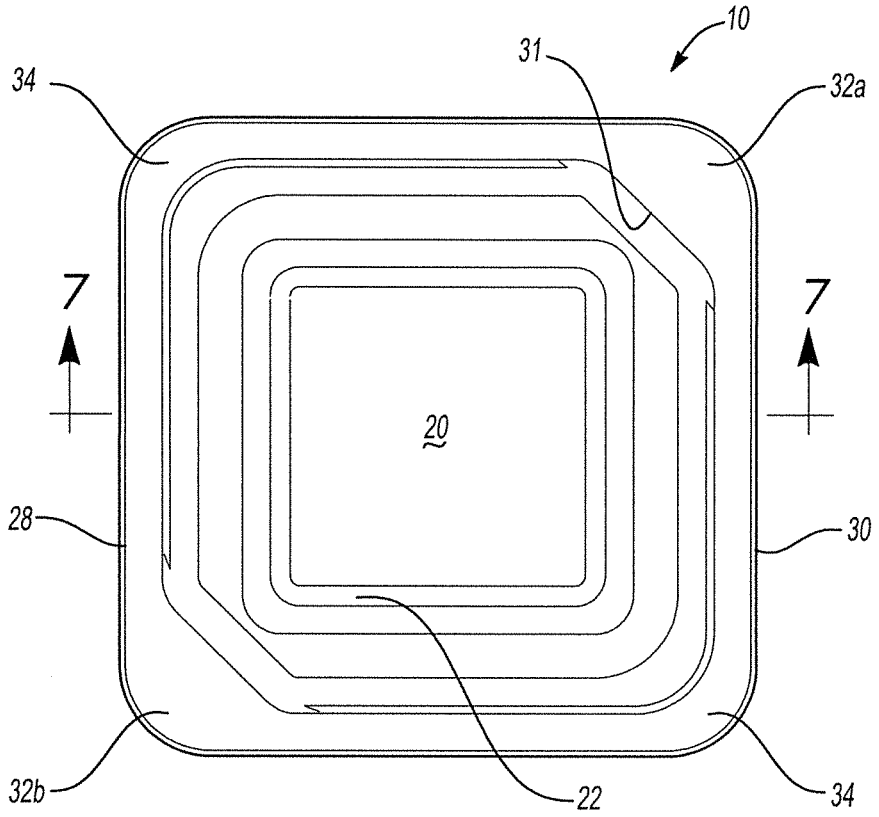
FIG. 6 illustrates a top view of the bowl having the depression.
Figure 7:
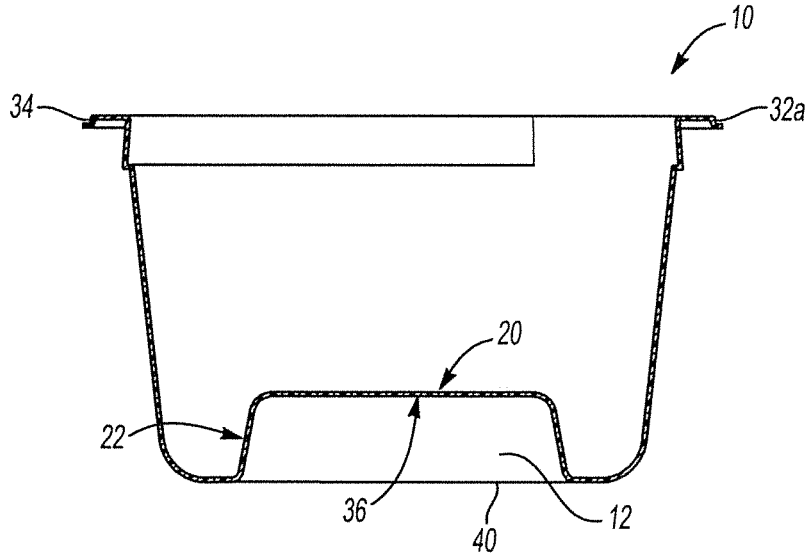
FIG. 7 illustrates a cross-sectional view of the bowl having the depression and the film installed.

The adhesive 42 secures the film 40 to the lower surface 16 of the bowl 10. As the user removes the film 40, the crackers 26 by means of the cracker wrapper 44 are removed from the compartment 12, as shown by movement arrow 52. FIG. 4 illustrates the cross section of the crackers, bowl, and adhesive along the line 4-4 (as shown in FIG. 3). A film 40 is provided having an adhesive 42 on an inner surface 50. The outer surface 48 is provided exposed to the environment. The adhesive 42 contacts the cracker wrapper 44. The crackers 26 are shown between the cracker wrapper 44 on both an upper surface of the crackers and a lower surface of the crackers. FIG. 4 further illustrates the bowl 10 or the indentation or compartment 12 disposed beneath the crackers (when the bowl is in an upside-down position as shown in FIGS. 3 and 4).

The wide square base of the bowl as seen in FIGS. 1-3 and 5-8 creates a broad surface thereby preventing most any accidental tippage of the bowl 10.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the appended claims:

We claim:

1. A bowl for storing and serving food products, the bowl comprising:

a bottom panel connected to at least one side panel, the at least one side panel and the bottom panel forming a bowl compartment, the bowl compartment adapted to hold a first product; and the bottom panel having an outer bottom surface, the outer bottom surface having an indentation extending into the bowl compartment, the indentation having a packaged second product, the indentation having a flexible film allowing the user to access the packaged second product contained within the indentation, the flexible film covering both the indentation and at least a portion of the outer bottom surface of the bottom panel so as to prevent air or water from entering the indentation and causing damage to the packaged second product, the flexible film and the bottom panel generally within the same plane; and the flexible film having an outer surface and an inner surface, the inner surface having an adhesive, the adhesive directly and removably connected to the bottom panel, the packaged second product removably connected to the adhesive of the flexible film thereby pulling the packaged second product out of the indentation when the flexible film is removed and allowing for removal of the packaged second product from the firm.

2. The bowl of claim 1 wherein the indentation is at least 0.25 inches deep.

3. The bowl of claim 1 wherein the indentation is at least between 0.25 to 2.5 inches deep.

4. The bowl of claim 1 wherein the indentation is at least 1.5 to 2.5 inches wide.

5. The bowl of claim 1 wherein the bowl is generally square in shape.

6. The bowl of claim 1 wherein the indentation is generally square in shape.

7. The bowl of claim 1 wherein at least two handles are provided on opposite sides of the bowl to facilitate pouring.

8. A bowl for storing and serving a first product and a second product, the bowl comprising:

a generally square bottom panel connected to at least one side panel, the at least one side panel and the bottom panel forming a bowl compartment configured to store the first product, an upper portion disposed spaced apart from and generally perpendicular to the bottom panel;

the upper portion having a pair of opposed handles adapted to facilitate pouring of the contents of the bowl, the pair of opposed handles disposed on opposing corners of the bowl;

the bottom panel having a bottom surface, the bottom surface having an indentation extending into the bowl compartment, the indentation adapted to store food, the indentation provided on the outside of the bottom surface of the bottom panel; and a flexible film removably attached directly to the bottom surface of the bottom panel, the flexible film covering a portion of the bottom surface, the flexible film covering the indentation, the second product removably connected to the film thereby allowing food to be stored in the indentation.

9. The bowl of claim 8 wherein the indentation is at least 0.25 inches deep.

10. The bowl of claim 8 wherein the indentation is between 0.25 to 2.5 inches deep.

11. The bowl of claim 8 wherein the indentation is at least 1.5 to 2.5 inches wide.

12. The bowl of claim 8 wherein the flexible film seals the indentation.

13. The bowl of claim 8 wherein the bowl is generally square in shape.

14. The bowl of claim 8 wherein the bowl is generally round in shape.

15. The bowl of claim 8 wherein the indentation is generally square in shape.

16. A bowl for storing and serving a first food product and a second food product, the second food product wrapped in a film packaging, the bowl comprising:

a generally square main vessel portion configured to hold the first food product, the generally rectangular main vessel portion formed from a plurality of interconnected side walls, the generally rectangular main vessel having a generally rectangular main opening, the interconnected side walls extending upwardly and away from the bottom wall, the interconnected side walls extending at a predetermined angle with respect to a generally vertical plane of the bowl thereby adding strength to the bowl;

an indentation formed into the bottom wall, the indentation extending into but not open to the generally rectangular main vessel portion, the indentation having a secondary opening configured to accept the second food product, the secondary opening mimicking the shape of the generally rectangular main opening, the indentation configured to hold the second food product, a flexible film covering both the indentation and at least a portion of the bottom wall, the flexible film and the bottom wall generally within the same plane, the flexible film creating a watertight and airtight seal of the indentation and the second food product; and the film packaging of the second food product removably connected to the flexible film thereby providing for easy removal of the second food product from the flexible film.

17. The bowl of claim 16 wherein the predetermined angle ranges between 5°-30°.

* * * * *